US007667564B2

(12) United States Patent
Skinner et al.

(10) Patent No.: US 7,667,564 B2
(45) Date of Patent: Feb. 23, 2010

(54) MULTICHARGE IGNITION COIL WITH PRIMARY ROUTED IN SHIELD SLOT

(75) Inventors: Albert Anthony Skinner, El Paso, TX (US); Mark Albert Paul, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 467 days.

(21) Appl. No.: 11/252,677

(22) Filed: Oct. 18, 2005

(65) Prior Publication Data

US 2007/0084433 A1 Apr. 19, 2007

(51) Int. Cl.
*H01F 27/04* (2006.01)

(52) U.S. Cl. ..... 336/96; 123/634; 123/210; 336/90; 336/92

(58) Field of Classification Search ..... 315/77; 324/399; 123/644, 634; 336/90, 92, 96
See application file for complete search history.

(56) References Cited

U.S. PATENT DOCUMENTS

| | | | | |
|---|---|---|---|---|
| 3,870,028 | A * | 3/1975 | Ishida | 123/598 |
| 4,514,712 | A * | 4/1985 | McDougal | 336/96 |
| 4,837,544 | A * | 6/1989 | McDougal | 336/185 |
| 5,014,676 | A | 5/1991 | Boyer | 123/637 |
| 5,019,779 | A * | 5/1991 | Ookawa | 324/388 |
| 6,023,215 | A * | 2/2000 | Sakamaki et al. | 336/96 |
| 6,054,859 | A * | 4/2000 | Takahashi et al. | 324/399 |
| 6,058,902 | A * | 5/2000 | Jacobs et al. | 123/198 DC |
| 6,125,385 | A * | 9/2000 | Wies et al. | 709/203 |
| 6,186,130 | B1 * | 2/2001 | Skinner et al. | 123/625 |
| 6,213,108 | B1 | 4/2001 | Boyer | 123/595 |
| 6,215,385 | B1 * | 4/2001 | Ogden | 336/96 |
| 6,367,318 | B1 | 4/2002 | Boyer | 73/116 |
| 6,378,513 | B1 | 4/2002 | Boyer | 123/625 |
| 6,463,918 | B1 * | 10/2002 | Moga et al. | 123/633 |
| 6,575,151 | B2 * | 6/2003 | Murata et al. | 123/647 |
| 6,624,596 | B1 * | 9/2003 | Ohsawa et al. | 315/276 |
| 6,672,295 | B2 * | 1/2004 | Kohno et al. | 123/644 |
| 6,856,227 | B2 * | 2/2005 | Ushio et al. | 336/198 |
| 6,909,351 | B2 * | 6/2005 | Gernert et al. | 336/90 |
| 2006/0091987 | A1 * | 5/2006 | Skinner et al. | 336/90 |

* cited by examiner

*Primary Examiner*—Douglas W Owens
*Assistant Examiner*—Chuc D Tran
(74) *Attorney, Agent, or Firm*—Thomas N. Twomey

(57) ABSTRACT

A plastic case surrounds a primary winding of a multicharge ignition system, and has a rib in which the high voltage end is routed back to the low voltage end, so that the low and high voltage ends can be closely juxtaposed with each other while advantageously permitting the primary winding to have one and only one winding layer to reduce resistance and size. The rib of the case extends into the slot of the magnetic shields of the winding.

14 Claims, 2 Drawing Sheets

MULTICHARGE IGNITION COIL WITH PRIMARY ROUTED IN SHIELD SLOT

FIELD OF THE INVENTION

The present invention relates generally to multicharge ignition coils.

BACKGROUND OF THE INVENTION

So-called "multicharge" vehicle ignition systems have been introduced for generating multiple spark events during combustion. Multicharge ignition systems generate a succession of spark breakdowns to ensure ignition of a combustible air/fuel mixture introduced into a cylinder of an internal combustion engine. The series of sparks increases the number of ignition events and hence the probability of combustion of the air/fuel mixture by extending the time and total energy available for combustion.

In greater detail, in multicharge systems an ignition coil undergoes an initial charge (i.e., initial dwell) wherein a primary current is established in a primary winding of the ignition coil. The initial dwell is immediately followed by an initial discharge of the ignition coil wherein a secondary current in a secondary winding of the multicharge coil discharges through a spark plug to generate a first spark. Subsequent recharge intervals (i.e., subsequent dwell periods) follow, accompanied by respective discharge intervals (i.e. spark events). The number of sparks produced is generally determined by a predetermined operating strategy.

As recognized herein, it is desirable from a performance standpoint that the primary winding of the multicharge coil have low resistance so that it has concomitantly rapid charge times. This implicates the use of a relatively large diameter wire with relatively few turns. As understood herein, should the primary winding be wound with the typical even number of layers so that both ends of the wire advantageously are disposed at the low voltage side of the coil (for, e.g., ease of electrical connection), the diameter of the part would be larger than if a single layer were used, increasing both the number of primary turns and the size of the device. Thus, to both reduce overall diameter and primary coil resistance, the present invention recognizes the desirability of limiting the primary winding to only a single layer. Use of a single layer, however, presents the problem of routing one of the ends of the winding back from the high voltage end to the low voltage end, and there is limited space in current coils to effect this. With this critical recognition in mind, the solution herein is provided.

SUMMARY OF THE INVENTION

A multicharge ignition system includes a primary winding low voltage terminal that can be connected to a component, such as, e.g., a switch, for receiving a signal from a multicharge ignition control circuit. The low voltage terminal is electrically connected to a low voltage end of a primary winding. A primary winding high voltage terminal is provided that can be connected to a power supply, such as a vehicle battery. The high voltage terminal is electrically connected to a high voltage end of the primary winding. One and only one primary winding layer is interposed between the ends. A first end segment of the winding, which may be the high voltage end segment but could alternatively be the low voltage end segment, is routed back toward the other end of the primary winding.

As set forth further below, a case can be provided that defines a rib, and the rib may be positioned in a slot that is associated with a magnetic shield assembly. The first end segment is disposed in the rib. A secondary winding may be closely juxtaposed with the primary winding and may be connectable to a spark plug of a vehicle.

In another aspect, an ignition system is disclosed for an internal combustion engine including an ignition coil having a primary winding and a secondary winding coupled to a spark plug in a combustion cylinder of the engine. The system also includes a switch that responds to an ignition control signal to cause a primary current to flow through the primary winding. A control circuit generates the ignition control signal to produce a plurality of sparks at the spark plug during a combustion event. The invention includes a case that at least partially surrounds the primary winding and that defines a substantially cylindrical outer surface and a longitudinal rib rising outwardly from the surface. The rib defines a channel, with a segment of the primary winding extending through the channel from a first voltage location to a second voltage location. A magnetic shield assembly at least partially surrounds the case. The shield assembly defines a slot, and the rib of the case is disposed in the slot of the shield assembly.

In this second aspect, the first voltage location is a high voltage location and the second voltage location is a low voltage location. Accordingly, a low voltage end of the primary winding is juxtaposed with a high voltage end of the primary winding owing to routing the segment through the channel of the rib. A core may be provided around which one and only one layer of the primary winding is wound, and the core may have a routing element around which the segment is routed into the channel of the rib. The routing element can be formed on the core nearer the high voltage location than the low voltage location, and may be established by, e.g., a post or a hook. Furthermore, a holding element may be formed on the core nearer the low voltage location than the high voltage location to hold the segment in place in close juxtaposition with the low voltage end of the primary winding. The holding element can be, e.g., a T-post or a wire snap groove.

In still another aspect, a multicharge ignition system includes a primary winding defining one and only one primary winding layer, a low voltage end, a high voltage end, and an end segment associated with one of the ends. Means are provided for routing the end segment back toward the end with which the end segment is not associated. Means for magnetically shielding the primary winding can accommodate the means for routing.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
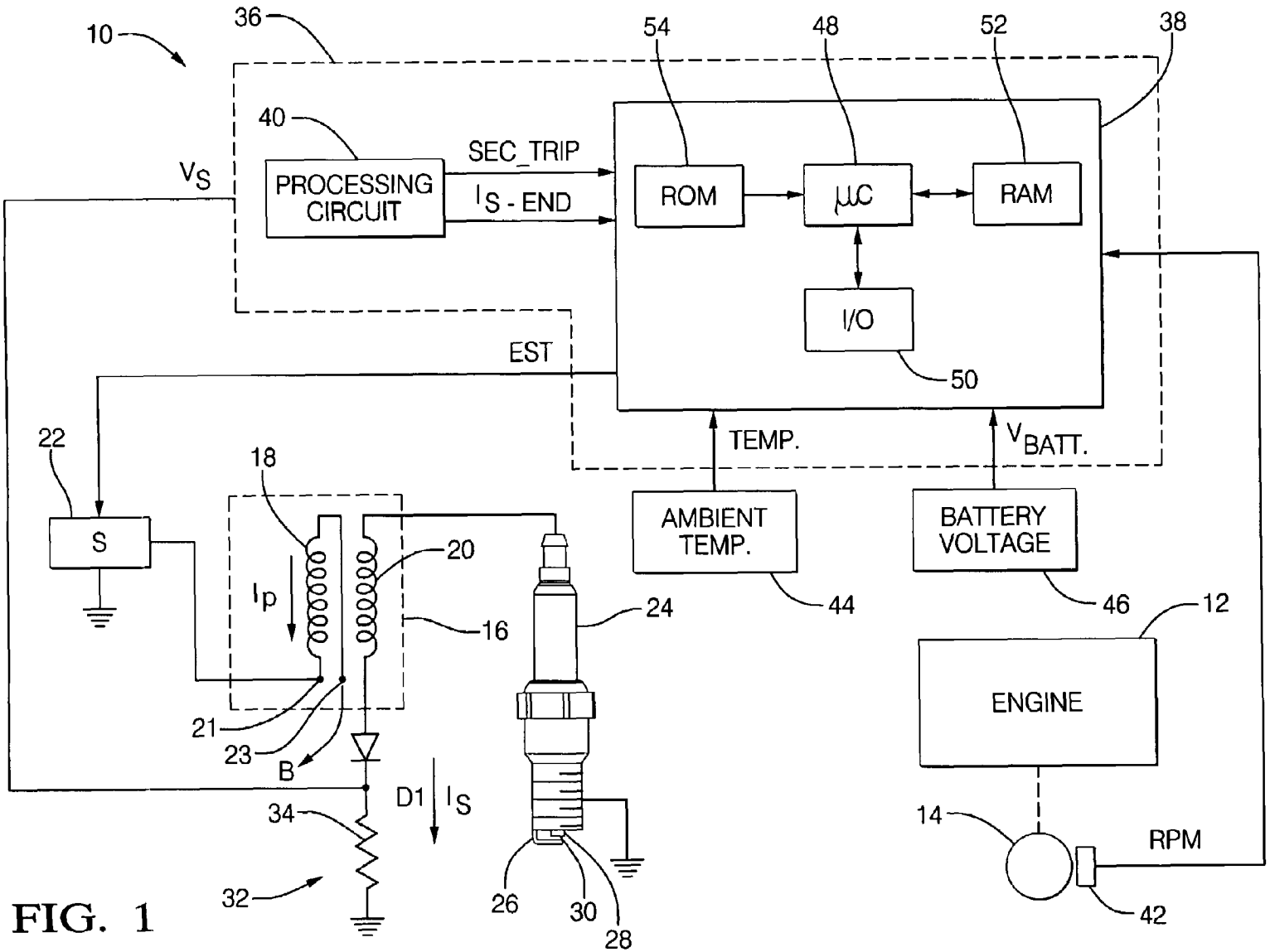
FIG. 1 is a schematic view of a non-limiting multicharge ignition system to which the present invention can be applied.

For illustration, FIG. 1 shows an exemplary non-limiting multicharge ignition system that can use the present multicharge ignition coil. It is to be understood that the invention is not limited by the particular system shown in FIG. 1, which is divulged to illustrate but one intended environment of the invention. The present multicharge ignition invention applies to all types of multicharge ignition systems.

Accordingly, referring initially to FIG. 1, an ignition control system is shown, generally designated 10, for an internal combustion engine 12. The engine 12 is of the type having a rotating crankshaft 14 to which are connected a plurality of pistons (not shown) disposed in respective cylinders (not shown) in a manner understood to those in the art. The engine 12 may be of the type having a direct ignition system for initiating combustion.

As shown in FIG. 1, the control system 10 includes a hollow, metal or plastic multicharge ignition coil housing 16 that supports a primary winding 18 and secondary winding 20, with each winding being wound around the same core or respective cores. In the non-limiting embodiment shown, the low voltage end of the primary winding 18 is associated with a terminal 21 that is connected to a switch 22. The primary winding 18 also has a terminal 23 associated with its high voltage end and connected to a power supply such as the vehicle battery "B". The switch 22 may be implemented by an insulated gate bipolar transistor (IGBT). FIG. 1 shows that owing to the novel routing described further below, the low and high voltage terminals 21, 23 are physically closely juxtaposed with each other.

The high voltage end of the secondary winding 20 is connected to a spark plug 24. The spark plug 24 may be conventional, e.g., it may include a first electrode 26 and a second electrode 28 spaced therefrom to define a gap 30.

For completeness of illustration of one non-limiting implementation of the multicharge ignition coil, a sensing circuit 32 may be provided that includes a resistor 34, with the low voltage end of the secondary winding 20 being connected to the resistor 34 (and thence to ground) through a diode D1 if desired. In turn, the sensing circuit 32 may be electrically connected to a control circuit 36. The control circuit 36 may include a controller 38 such as a digital controller and a processing circuit 40 which may receive input from a speed sensor 42, a temperature sensor 44, and a battery voltage sensor 46. The controller 38 itself may include a central processing unit or microcontroller 48, input/output (I/O) circuitry 50, a random access memory (RAM) 52, and a read only memory (ROM) 54. The ROM 54 may be provided for read only storage of program instructions, data constants and calibration values, with the microcontroller 48 reading and executing program instructions stored in ROM 54 for carrying out the control of the multicharge ignition system. The RAM 52 may be used for storage of data of the type which may be cleared when, for example, ignition power is removed. Further details of the system 10 with control circuit 36 are set forth in U.S. Pat. No. 6,186,130, incorporated herein by reference. In any case, the primary winding 18 and secondary winding 20 are matched in a predetermined manner known in the art. In the non-limiting illustrated embodiment of FIG. 1, one ignition coil 16 is provided per plug 24.

As set forth in the above-referenced patent, the switch 22 is provided to selectively connect the primary winding 18 to ground, in accordance with a control voltage comprising an ignition control signal, sometimes referred to as electronic spark timing (EST). Such a connection to ground, as is known generally in the art, will cause a primary current $I_p$ to flow through primary winding 18. During the spark event at the spark plug 24, a secondary current, designated $I_s$, flows across the spark plug gap 30 through the plug 24 and through secondary winding 20 and thence to ground by way of the diode D1 and the resistor 34. Details of how the exemplary non-limiting control circuit 36 generates the ignition control signal and selectively imposes it on the primary winding 18 through the switch 22 in response to one or more inputs from the speed, temperature, and voltage sensors are set forth in the above-referenced patent and will be omitted for clarity.

Figure 2:
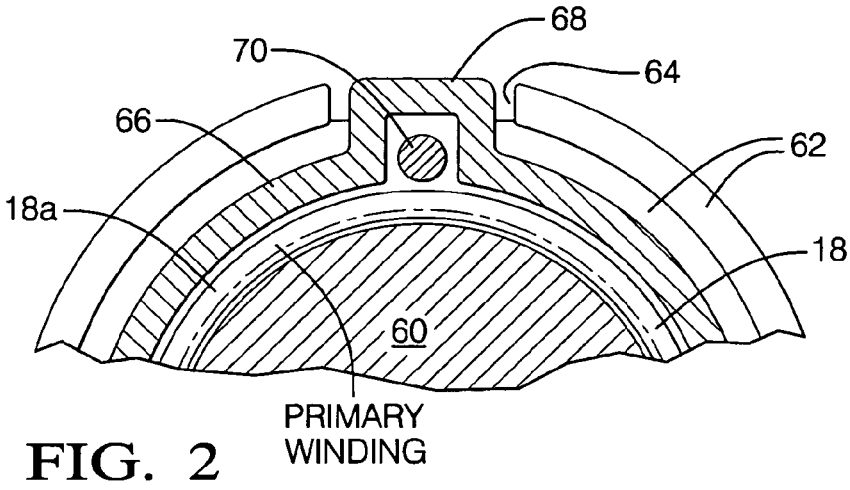
FIG. 2 is a transverse partial cross-section of the primary coil, with portions cut away for clarity.
Figure 3:
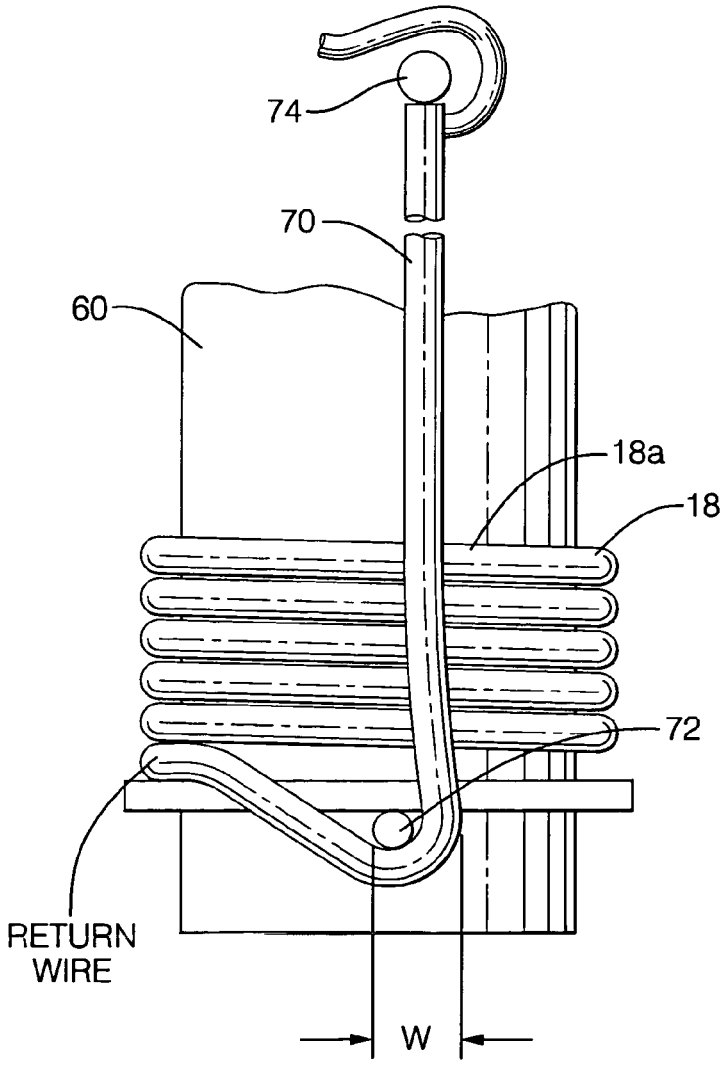
FIG. 3 is a top view of the primary coil, with portions cut away.

Now referring to FIGS. 2 and 3, the construction of the primary winding 18 can be seen. The primary winding 18 is wound in one and only one layer 18*a* around a core 60 that can have a cylindrical outer surface. Plural cylindrically-shaped magnetic shields 62 that in one aspect can be regarded as a shield assembly can be disposed around the primary winding 18, potentially in plural layers as shown, in accordance with principles known in the art to provide a magnetic shield between the primary winding 18 and the environment. To avoid the unwanted generation of eddy currents in the shields, a slot 64 is formed between adjacent shield elements, i.e., while the shields 62 are cylindrically-shaped no shield element by itself establishes a complete cylinder.

A non-conducting, preferably plastic, generally cylindrical hollow case 66 surrounds the primary winding 18 as shown and is disposed between the winding 18 and shields 62. The case 66 is substantially cylindrical except for a hollow rib 68 that is formed longitudinally on the case and that extends above the otherwise cylindrical outer surface as shown, into the shield slot 64. In cross-section, as shown in FIG. 2 the hollow rib 68 may be rectilinear. Regardless of the transverse shape of the rib, a return portion 70 of the winding 18, i.e., the high voltage end portion of the primary winding 18, is routed back to the low voltage end of the coil through the channel that is defined by the hollow rib 68 in a linear configuration as shown.

FIG. 3 shows that at the high voltage end of the primary winding 18, a routing element 72 such as a post or hook can be located on the core 60 around which the return portion 70 can be routed into the channel formed by the case rib 68. The minimum width of the case rib 68 channel thus must equal the width "W" of the routing element 72 plus diameter of the primary winding wire.

At the low voltage end, a holding element 74 such as a T-post or wire snap groove can be formed on or adhered to the core 60 to hold the high voltage end of the primary winding 18 in place at the low voltage end of the core 60. i.e. in close juxtaposition with the low voltage end of the primary winding 18. In the illustrated embodiment the primary winding structure shown may be configured similar to a so-called pencil coil. Although FIGS. 2 and 3 show that the high voltage end segment is routed back through the rib channel toward the low voltage end, in other embodiments a low voltage end segment equivalently could be routed back toward the high voltage end.

While the particular MULTICHARGE IGNITION COIL WITH PRIMARY ROUTED IN SHIELD SLOT as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". It is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. Absent express definitions herein, claim terms are to be given all ordinary and accustomed meanings that are not irreconcilable with the present specification and file history.

What is claimed is:

1. An ignition system for an internal combustion engine including an ignition coil having a primary winding and a secondary winding coupled to a spark plug in a combustion cylinder of the engine, a switch responsive to an ignition control signal for causing a primary current to flow through the primary winding, a control circuit configured to generate the ignition control signal so as to produce a plurality of sparks at the spark plug during a combustion event in the cylinder, characterized by:

a case at least partially surrounding the primary winding, the case defining a substantially cylindrical outer surface and a longitudinal rib rising outwardly from the surface, the rib defining a channel, a segment of the primary winding extending through the channel from a first voltage location to a second voltage location wherein the first voltage location is a high voltage location and the second voltage location is a low voltage location, whereby a low voltage end of the primary winding is juxtaposed with a high voltage end of the primary winding owing to routing the segment through the channel of the rib; and at least one magnetic shield assembly at least partially surrounding the case, the shield assembly defining a slot, the rib being disposed substantially in the slot.

2. The system of claim 1, comprising a core around which one and only one layer of the primary winding is wound.

3. The system of claim 2, comprising at least one routing element on the core around which the segment is routed into the channel of the rib, the routing element being on the core nearer the high voltage location than the low voltage location.

4. The system of claim 3, wherein the routing element is a post.

5. The system of claim 3, wherein the routing element is a hook.

6. The system of claim 2, comprising at least one holding element on the core nearer the low voltage location than the high voltage location, the holding element holding the segment in place in close juxtaposition with the low voltage end of the primary winding.

7. The system of claim 6, wherein the holding element is a T-post or a wire snap groove.

8. A multicharge ignition system, comprising:

a primary winding low voltage terminal connectable to a component for receiving a signal from a multicharge ignition control circuit, the low voltage terminal being electrically connected to a low voltage end of a primary winding;

a primary winding high voltage terminal connectable to a power supply and electrically connected to a high voltage end of the primary winding;

one and only one primary winding layer interposed between the ends, wherein a first end segment of the winding is associated with the high voltage end and is routed back toward the low voltage end of the primary winding; and a case defining a rib positioned in a slot associated with a magnetic shield assembly, the first end segment being disposed in the rib.

9. The system of claim 8, comprising a secondary winding closely juxtaposed with the primary winding and connectable to a spark plug of a vehicle.

10. The system of claim 9, wherein the windings are disposed in a housing mounted in a vehicle.

11. A multicharge ignition system, comprising:

a primary winding defining one and only one primary winding layer, a low voltage end, a high voltage end, and an end segment associated with one of the ends;

means for routing the end segment back toward the end with which the end segment is not associated; and means for magnetically shielding the primary winding wherein the means for magnetically shielding defines a slot between adjacent ends of the shielding means and the means for routing includes a rib on a case surrounding the primary winding between the winding and the means for magnetically shielding, the rib being disposed in the slot, the means for magnetically shielding accommodating the means for routing.

12. The system of claim 11, comprising a secondary winding closely juxtaposed with the primary winding.

13. The system of claim 12, comprising a high voltage terminal connected to the high voltage end and connected to a vehicle battery.

14. The system of claim 13 comprising a low voltage terminal connected to the low voltage end and connected to a multicharge ignition control system.

* * * * *